US008061435B2

(12) United States Patent
Gunnarson

(10) Patent No.: US 8,061,435 B2
(45) Date of Patent: Nov. 22, 2011

(54) SYSTEM FOR MOUNTING A PILE DRIVER

(76) Inventor: Jay Gunnarson, Grande Prairie (CA)

( * ) Notice: Subject to any disclaimer, the term of this patent is extended or adjusted under 35 U.S.C. 154(b) by 0 days.

(21) Appl. No.: 11/934,248

(22) Filed: Nov. 2, 2007

(65) Prior Publication Data

US 2008/0110657 A1 May 15, 2008

Related U.S. Application Data

(60) Provisional application No. 60/856,337, filed on Nov. 3, 2006.

(51) Int. Cl.
*E21B 1/021* (2006.01)

(52) U.S. Cl. ..... 173/1; 173/184

(58) Field of Classification Search ..... 173/13, 173/184, 90, 190, 152, 141, 186, 187, 28, 173/42, 44; 405/232, 239
See application file for complete search history.

(56) References Cited

U.S. PATENT DOCUMENTS

| | | | | |
|---|---|---|---|---|
| 2,661,189 | A * | 12/1953 | Gillerstrom | 384/24 |
| 3,809,344 | A * | 5/1974 | Kolderup et al. | 173/185 |
| 3,869,003 | A * | 3/1975 | Yamada et al. | 175/171 |
| 3,935,953 | A | 2/1976 | Stedman | |
| 4,099,579 | A * | 7/1978 | Stormon | 173/4 |
| 4,116,346 | A | 9/1978 | Uchida | |
| 4,214,840 | A | 7/1980 | Beales | |
| 4,301,607 | A | 11/1981 | Inui | |
| 4,316,697 | A | 2/1982 | Yokoyama | |
| 4,392,314 | A | 7/1983 | Albrecht et al. | |
| 5,375,664 | A | 12/1994 | McDowell et al. | |
| 5,382,110 | A | 1/1995 | Perotto et al. | |
| 5,431,528 | A | 7/1995 | Jenkins et al. | |
| 5,551,519 | A | 9/1996 | Pach | |
| 5,810,101 | A * | 9/1998 | Caraway et al. | 175/78 |
| 5,944,452 | A | 8/1999 | Reinert, Sr. | |
| 6,293,732 | B1 * | 9/2001 | Baugh | 405/170 |
| 6,715,564 | B2 | 4/2004 | Buckland | |
| 7,100,709 | B2 * | 9/2006 | Bowe et al. | 175/113 |
| 7,198,115 | B2 | 4/2007 | Cardoso | |
| 2005/0169703 | A1 * | 8/2005 | Fatemi | 403/321 |
| 2005/0247461 | A1 | 11/2005 | Cardoso | |
| 2006/0213676 | A1 * | 9/2006 | Jinnings et al. | 173/184 |
| 2007/0127990 | A1 | 6/2007 | Cardoso | |

OTHER PUBLICATIONS

Photographs of prior art Commercially Available Pile Drivers.

* cited by examiner

*Primary Examiner* — Paul Durand
*Assistant Examiner* — Nathaniel Chukwurah
(74) *Attorney, Agent, or Firm* — Pillsbury Winthrop Shaw Pittman LLP

(57) ABSTRACT

A system for mounting a lead assembly on a construction machine including a set of leads having a driver that is slidably mounted to the set of leads. The system further includes at least one lifting component for engaging the driver and moving the driver on the leads, and a pivotable mounting assembly mounted to the set of leads and adapted to adjust the position of the set of leads. Moreover there is a quick connecting portion adapted to engage the pivotable mounting assembly and the construction machine so as to allow for the quick engagement and disengagement of the construction machine from the set of leads.

17 Claims, 6 Drawing Sheets

DETAIL A
32
24

DETAIL B
42
34
40

DETAIL A
28

22
20
12
10
DETAIL B
14
30
41
24
16

SYSTEM FOR MOUNTING A PILE DRIVER

This application claims the benefit of U.S. Provisional Application No. 60/856,337 filed Nov. 3, 2006.

FIELD OF THE INVENTION

This invention relates in general to attachment systems for construction equipment and more particularly to a system for mounting a lead to construction equipment such as an excavator.

BACKGROUND OF THE INVENTION

Different types of construction conditions often require different types of equipment to be able to accurately and properly prepare foundations for future construction. Typically this type of construction may be achieved by pile driving, screw piling, drilling or by auger for example. In general foundations are often pilings that are used to support the structure being built. The type of piling required and the depth that the piling must be driven into the earth will also depend on the type of structure being built. With large structures, the pilings by necessity are large to provide sufficient support and have to be driven through the earth and underlying bedrock with a great deal of force. Traditionally in the construction industry, the pile driving of these large pilings has been performed by mounting a pile driver to a crane. This requires the costly and time consuming transportation of a crane to the construction site as well as the engagement of a qualified crane operator. Typical pile drivers include a hammer mounted to a frame or leads and have a ram that engages the pile with a downward force. For accurate driving of the pilings and avoidance of damage to the frame, there has to be a proper alignment of the leads relative the piling being driven. In other construction operations leads are often mounted to a crane so as to operate a drilling system, auger system or screw pile.

Prior art lead attachment mechanisms for pile drivers and the like have been devised to address some of the noted problems. For example United States Pub. Patent Appln No. 2005/0247461 was filed on May 6, 2004 by Cardoso and relates to a construction equipment attachment for driving an object, such as a timber piles, steel piles, pipe piles, steel sheet piles, h-beam and the like. The attachment includes a hammer slidably coupled to a lead, a lead mounting assembly and a hydraulic actuator coupled to the lead and the lead mounting assembly. The hydraulic actuator is adapted to control the orientation of the lead relative to the lead mounting assembly.

U.S. Pat. No. 6,715,564 which issued on Apr. 6, 2004 to Buckland relates to a drilling rig having a boom supporting a leader. The leader is pivotally attached to the boom and is moveable between a generally upright orientation and a generally horizontal orientation for the purposes of transportation by a vehicle. Hydraulic rams cause linear movement of the leader relative to the boom while the hydraulic ram causes tilting of the boom about a generally horizontally axis.

U.S. Pub. Patent No. 2006/0213676 which was filed on Mar. 7, 2006 for Jinnings et al, relates to a pile driver including an apparatus for allowing relative movement between a hammer and a boom of an excavator. The apparatus includes a mounting plate mounted to the boom that inter-fits with and is slidable with respect to a frame rail mounted to the hammer. In operation, the hammer is placed on top of a pile and, as the pile is driven downwardly, the hammer follows the pile down.

U.S. Pat. No. 5,375,664 which issued on Dec. 27, 1994 to McDowell et al relates to a hydraulic pile driver including a backhoe, a lead, a vibratory hydraulic hammer, and a winch, for driving pin pile or needle pile into the ground. The lead is limited in height, as is the backhoe in size, so that the pile driver can be used within the interiors of many building structures. The vibratory hydraulic hammer operates at a rate greater than 400 blows per minute and generates a force greater than 100 foot-pounds.

U.S. Pat. No. 5,551,519 which issued on Sep. 3, 1996 to Pach relates to a device for driving piles, preferably poles, into a foundation. The device for ramming pole foundations limits idle times between ramming operations and takes the form of a self-propelled rail-road or dual purpose vehicle that can be driven on rails laid on a ballast or over a road surface and the vehicle can swivel over 360° with a top in relation to the undercarriage, with an operation cabin, a counter weight and a hoisting arm being arranged on the noted top, with a turning and tilting unit being provided at a free end of the hoisting arm, with a leader having a rammer mounted in a guiding unit, wherein, in the working position, the leader stands vertically and the top is turned 90° with respect to the direction of the rails and, when the ramming operation is finished, the leader is centrally clamped by the guiding unit and is turned 90° by the turning and tilting unit, with the leader and rammer then being shouldered by the hoisting arm and the device can thus be driven to the next ramming position.

U.S. Pat. No. 5,944,452 which issued on Aug. 31, 1999 to Reinert, Sr. relates to a heavy duty mobile metal foundation installation apparatus and method which includes a push-it carriage movably supported through controllable positioning to push a metal foundation into the ground by hydraulic cylinders pushing against a header frame held and secured in adjustable positions on a heavy duty mobile push-it tower. The heavy duty mobile push-it tower and metal foundation holder and push-it carriage mounted on the heavy duty tower are attached to a track roller frame tractor structure. The push-it tower is attached to the track roller frame tractor structure by a hydraulically activated tractor boom arm, a pivot point on the tower, and a hydraulic cylinder for rotating and positioning the tower about the pivot attachment point.

Thus a system for mounting a lead attachment assembly which allows for the timely and cost effective mounting of a lead attachment assembly for the operation of a pile driver or the like to an excavator with the ability to adjust the alignment and the positioning of the lead assembly and therefore the pile driver for example is desirable.

SUMMARY OF THE INVENTION

An object of one aspect of the present invention is to provide an improved system for mounting a lead attachment assembly.

In accordance with one aspect of the present invention there is provided a system for mounting a lead assembly on a construction machine including a set of leads having a driver that is slidably mounted to the set of leads. The system further includes at least one lifting means for engaging the driver and moving the driver on the leads, and a pivotable mounting assembly mounted to the set of leads and adapted to adjust the position of the set of leads. Moreover there is a quick connecting means adapted to engage the pivotable mounting assembly and the construction machine so as to allow for the quick engagement and disengagement of the construction machine from the set of leads. The system may be mounted both to a stick or to a boom of a construction machine.

In accordance with one aspect of the present invention there is provided a system for mounting a pile driver to a front stick of an excavator for driving piles including a lead assembly that has a hammer slidably mounted to the lead assembly. The lead assembly further includes at least two lifting means and an aligning means adapted to align the pile once positioned in the lead assembly. A pivotable mounting assembly is mounted to the lead assembly and adapted to adjust the position of the lead assembly. The system further includes a quick connecting means adapted to engage both the pivotable mounting assembly and the front stick of the excavator.

Conveniently, the first lifting means lifts the pile into the lead assembly and the second lifting means lifts and lowers the hammer. The aligning means may be defined as at least one paddle or arm, though there may be multiple paddles to align the pile within the leads to ensure that the pile is driven accurately.

Preferably, the pivotable mounting assembly includes a mounting head that pivots to a maximum 20° left or right on a vertical plane. The quick connecting means allows for the quick connect of the pile driver to the excavator. Typically the system is utilized to drive pilings having at least 6" diameter and a length of 40 feet. Conveniently the system may also be mounted on a boom of an excavator or other type of construction equipment using the quick connections means.

In accordance with another aspect of the present invention there is provided a system for mounting a drilling system to a front stick of an excavator including a lead assembly that has a drilling member slidably mounted to the lead assembly. The lead assembly further includes at least one lifting means. A pivotable mounting assembly is mounted to the lead assembly and adapted to adjust the position of the lead assembly. The system further includes a connecting means adapted to engage both the pivotable mounting assembly and the front stick of the excavator.

Advantages of the present invention are: the system can be used on different types of construction equipment and be used to attach leads for use with piles, screw piles, augers or drills, the pile driver can be mounted to the construction equipment such as an excavator without having to remove the stick or arm of the excavator therefore the excavator is fully functional while the pile driver is mounted to the excavator, however it can also be mounted to the boom of the construction equipment, the system has a quick connect feature to attach the leads of the pile driver to the excavator for improved time saving so that operation of actual pile driving can happen more quickly, furthermore ease of attaching and detaching the pile driver allows for switching between the use as a pile driver and an excavator in a short period of time, increased cost saving to the construction project as it does not require the use of a crane or a specialized crane operator to operate the pile driver, typically the excavator boom does not move once during the driving of piles, system allows for a variety of hammers to be used, the system also allows for a wide variety of other types of equipment to be mounted to the excavator namely various types of drills, ability to drive very large diameter piles, the pile driver can be operated off the excavator or it can be operated by a separate power pack, system allows for a number of points of adjustment to help correctly align the leads, namely left and right, and forward and backward, and leads are at least 48 feet tall to drive large piles similar to those driven by cranes.

BRIEF DESCRIPTION OF THE DRAWINGS

A detailed description of the preferred embodiments is provided herein below by way of example only and with reference to the following drawings, in which.

Figures 1A, 1B, 1C, 1D:
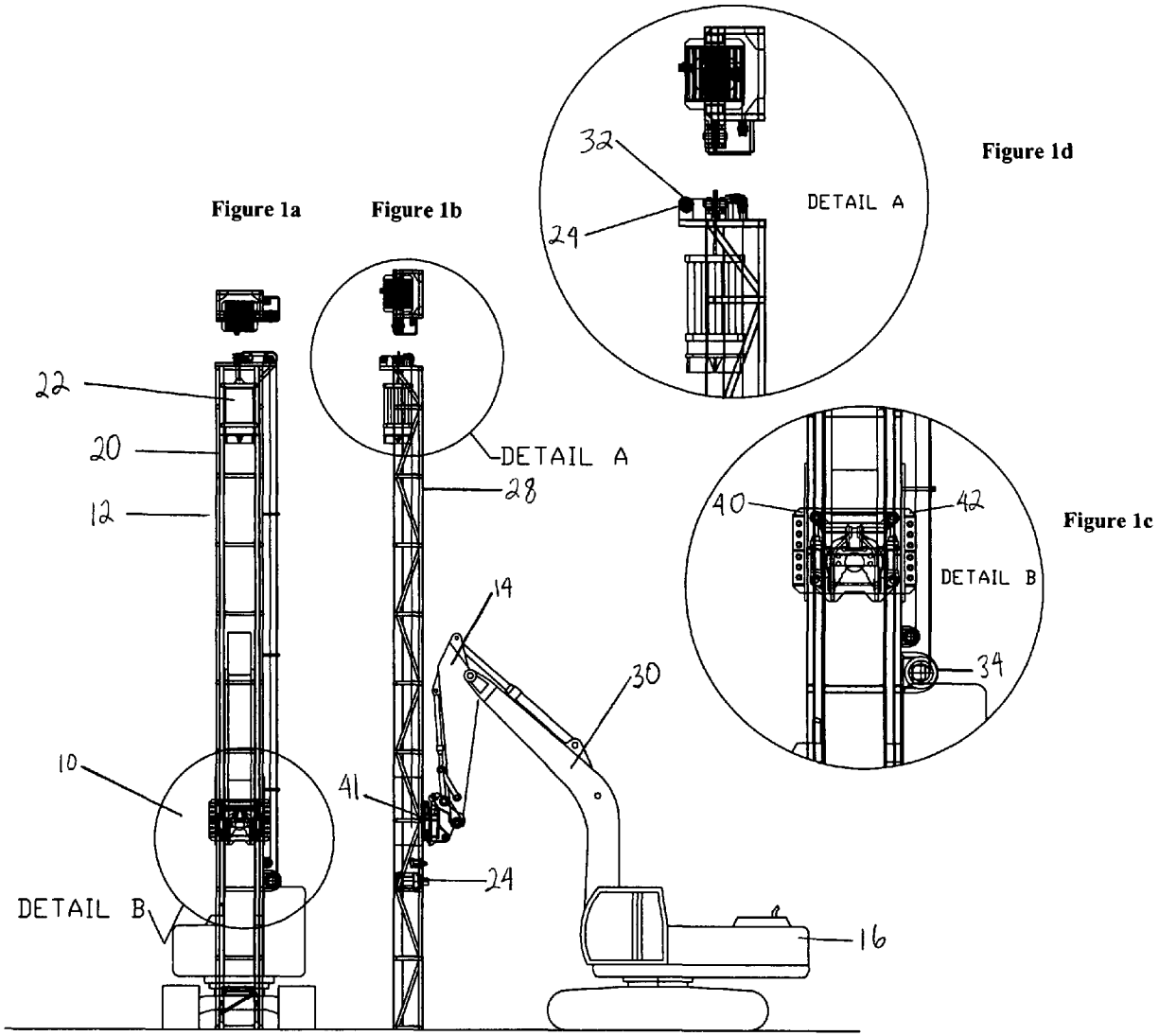
FIG. 1*a* in a front elevational view, illustrates a system for mounting a pile driver to the front stick of an excavator in accordance with a preferred embodiment of the present invention.
FIG. 1*b* in a side elevational view, illustrates a system for mounting a pile driver to the front stick of an excavator in accordance with a preferred embodiment of the present invention.
FIG. 1*c* in a front plan view, illustrates the pivotable mounting system mounted to the lead assembly and the front stick of the excavator FIG. 1*d* in a top plan view and side elevational view, illustrates the lead assembly and hammer of FIG. 1*b*.
Figure 2C:
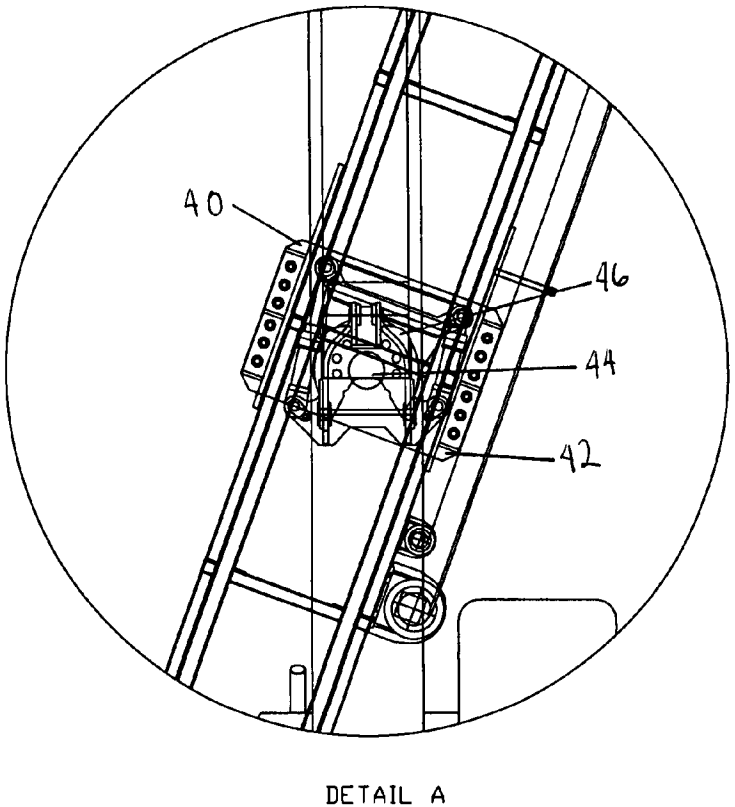
FIG. 2*c* in a front plan view, illustrates the pivotable mounting assembly mounted to the lead assembly.
Figure 2B:
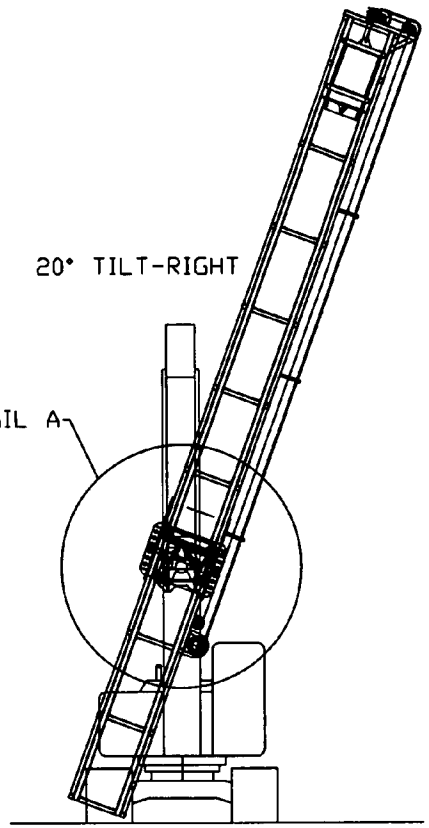
FIG. 2*b* in a front plan view, illustrates the lead assembly of FIG. 1*a* tilting to the right.
Figure 2A:
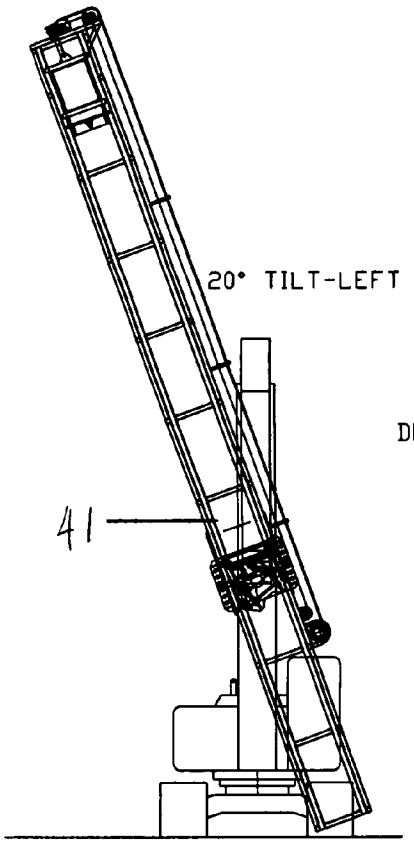
FIG. 2*a* in a front plan view, illustrates the lead assembly of FIG. 1*a* tilting to the left.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Referring to FIGS. 1 to 6 there is illustrated a system 10 for mounting a lead assembly 20 on a construction machine 16 including a set of leads 28 having a driver 27 that is slidably mounted to the set of leads 28. The system 10 further includes at least one lifting means 24 for engaging the driver 27 and moving the driver 27 on the leads 28, and a pivotable mounting assembly 40 mounted to the set of leads 28 and adapted to adjust the position of the set of leads 28. Moreover there is a quick connecting means 46 adapted to engage the pivotable mounting assembly 40 and the construction machine 16 so as to allow for the quick engagement and disengagement of the construction machine 16 from the set of leads 28.

The driver 27 may be a hammer typically used in pile driving, or a screw pile, a drill or an auger by way of example only. Furthermore the system 10 may be mounted to a variety of construction machines, including an excavator and more specifically can be mounted to the stick or boom of the machine using the quick connection means.

Referring to FIGS. 1*a* to 1*d*, there is illustrated in front, side and top plan views, a system 10 for mounting a pile driver 12 to a front stick 14 of an excavator 16 in accordance with a preferred embodiment of the present invention. The system 10 for mounting a pile driver 12 to the front stick 14 of excavator 16 for driving piles 18 includes a lead assembly 20 that has a hammer 22 slidably mounted to the lead assembly 20. The lead assembly 20 further includes at least one lifting means 24 and an aligning means 26 adapted to lift and align the pile 18 once positioned in the lead assembly 20. The lead assembly 20 may be further defined as a set of leads 28 such as a U-shape or H-beam configuration by way of example only. The hammer 22 is slidable mounted to the set of leads 28 which allows the hammer 22 to seamlessly move up and down along the set of leads 28. The set of leads 28 may preferably be 48 feet long by way of example only, to accommodate large piles but can be up to 80 feet long. Once the hammer 22 is engaged to drive the pile 18, the excavator 16, and more specifically the front stick 14 and the boom 30 of the excavator 16 do not move. Depending on the type of construction machine or excavator 16 being used, it is possible that the set of leads 28 could be lighter to accommodate a smaller excavator while maintaining the same length if desired.

Figure 4A:
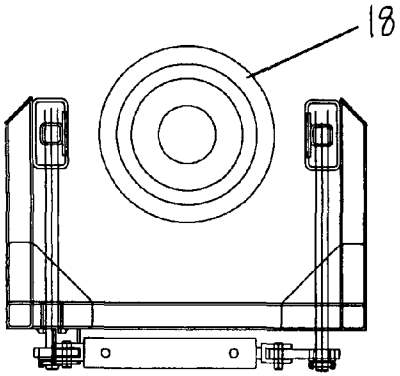
FIG. 4*a* in a top plan view illustrates the aligning means of the system of mounting a pile driver of FIG. 1.
Figure 4B:
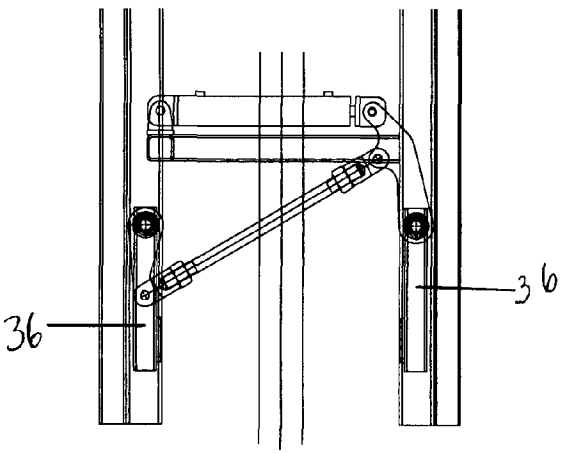
FIG. 4*b* in a front plan view illustrates the aligning means of FIG. 4*a*.
Figure 4C:
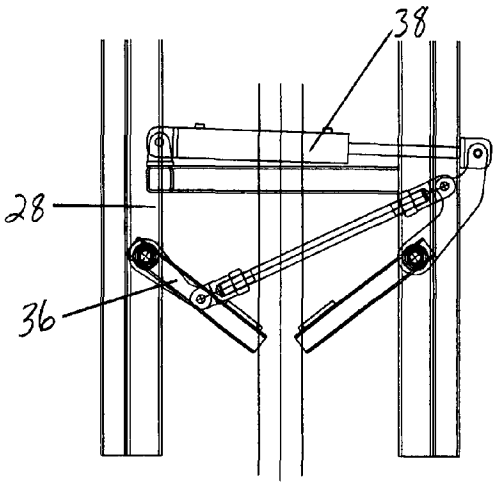
FIG. 4*c* in a front plane view illustrates the aligning means of FIG. 4*a*.
Figure 4D:
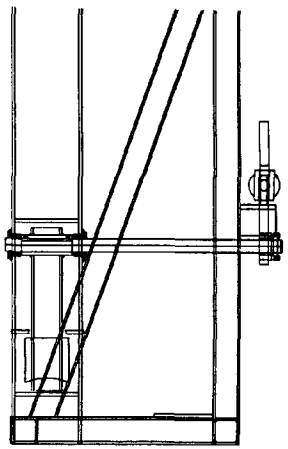
FIG. 4*d* in a side view illustrates the aligning means of FIG. 4*a*.
Figure 5A:
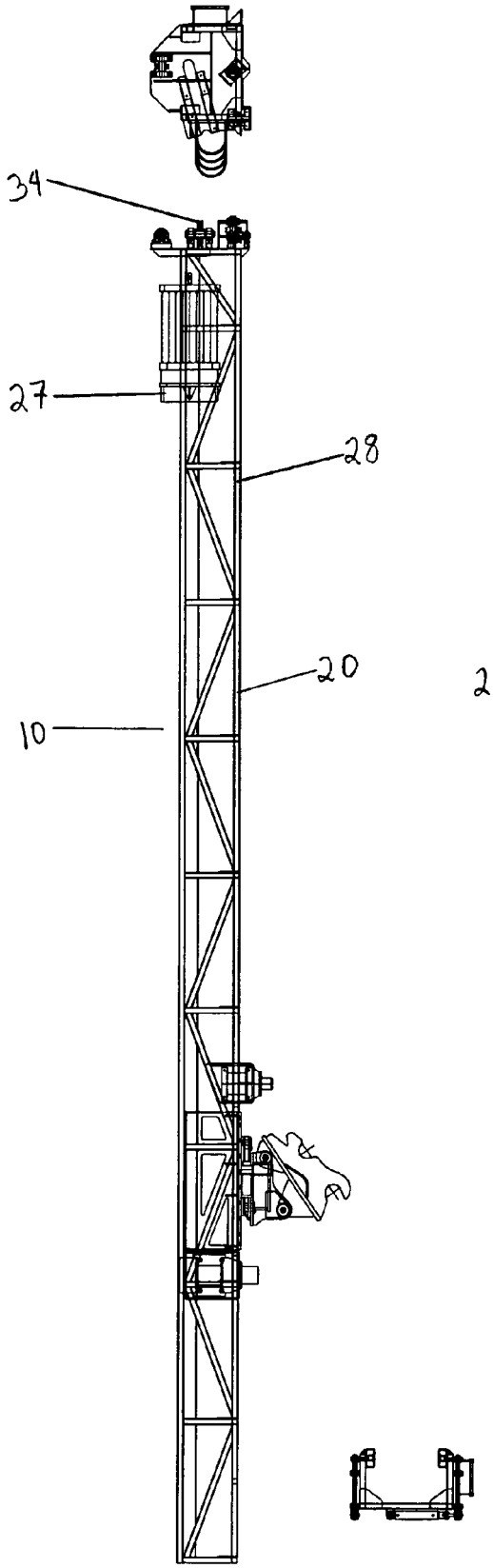
FIG. 5*a* in a side view illustrates the system of the preferred embodiment.
Figure 5B:
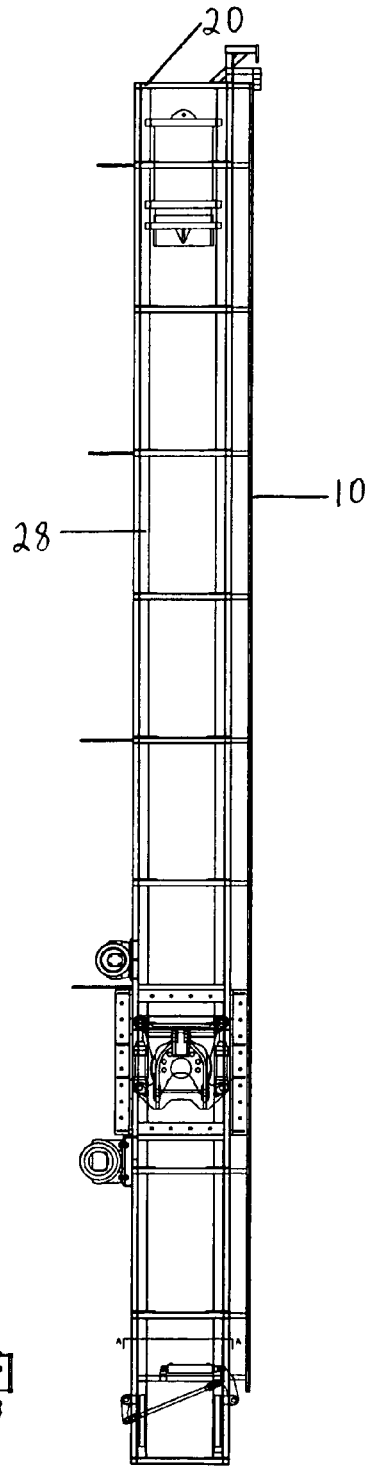
FIG. 5*b* in a front view illustrates the system of the preferred embodiment.

The lifting means 24 may include a the first lifting means 32 that lifts the pile into the lead assembly 20 and a second lifting means 34 that lifts and lowers the hammer 22. The first and second lifting means may be defined as hydraulic winches by way of example only. Referring to FIGS. 4*a* to 4*c*, the aligning means 26 may be defined as at least two paddles 36 or arm and an engaging mechanism 38. The aligning means 26 may be located at the bottom of the set of leads 28 and can engage to align the pile 18 correctly. Preferably the aligning means 26 may include two paddles 36 that engage the pile 18.

Referring to FIGS. 2*a* to 2*c*, and FIGS. 6*a* to 6*c*, a pivotable mounting assembly 40 is mounted to the lead assembly 20 and is adapted to adjust the position of the lead assembly 20. Typically the pivotable mounting assembly 40 may be secured to the lead assembly at a point within an attachment zone 41. The attachment zone is defined as an area on the set of leads 28 that allows for the correct positioning of the set of leads 28 relative the excavator 16. The pivotable mounting assembly 40 includes mounting head 42 that has a pivoting mechanism 44 that allows for the pivot of the lead assembly 20 up to a maximum 20° left or right on a vertical plane. The ability to pivot the lead assembly 20 allows for the adjustment and alignment of the lead assembly 20 according to the operators needs. Furthermore this adjustment does not involve any movement of the front stick 14 or boom 30 of the excavator 16.

Figures 6A, 6B, 6C:
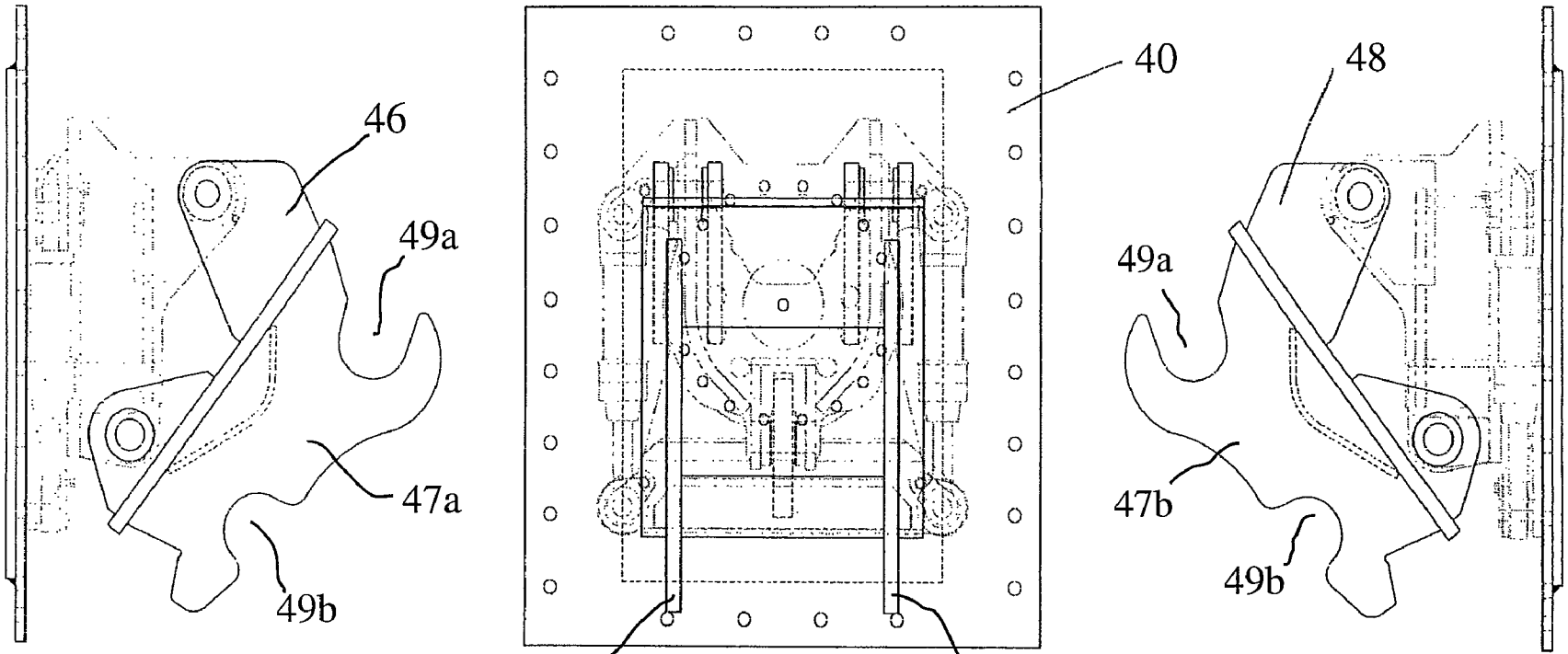
FIG. 6*a* in a side view illustrates the pivotable mounting assembly of the preferred embodiment of the present invention.
FIG. 6*b* in a front view illustrates the pivotable mounting assembly of the preferred embodiment of the present invention.
FIG. 6*c* in a side view illustrates the pivotable mounting assembly of the preferred embodiment of the present invention.

The system 10 further includes a quick connecting means or quick connect coupling 46 that is connected to the pivotable mounting assembly 40 and configured to removably and releasably mount to the front stick 14 of the excavator 16. The quick connecting means 46 may be further defined as a quick change adapter 48 that is mounted to the mounting head 42. As shown in FIGS. 6*a* to 6*c*, the quick change adapter 48 includes a pair of spaced-apart plates 47*a*, 47*b*, with each plate having a pair of recesses 49*a*, 49*b* formed in an edge thereof. The quick change adapter 48 therefore allows the pivotable mounting assembly 40 and therefore the lead assembly 20 to be quickly mounted to the front stick 14 of the excavator 16. The quick change adapter 48 mounts to the front stick 14 where the excavator bucket is usually mounted. Therefore the front stick 14 of the excavator 16 does not have to be removed as in the case of some mounting systems for pile drivers. Furthermore the quick connecting means 46 may also be mounted on the boom of the excavator if desired. As such the excavator 16 can be converted from its traditional use, to its use with a pile driver 12 within thirty minutes of switching attachments.

As such, the time saved allows for more cost effective use of equipment at the construction site as only one piece of equipment namely the excavator 16 is needed to allow for a fully functioning pile driver 12, where as traditionally a crane and a specialized crane operator was needed for operating the pile driver at increased expense and time to the construction project. The present invention may also be used with a spotter (not shown) mounted to the bottom of the lead assembly 20 that may be attached to the construction machine 16 such as the excavator so as to accommodate a lead assembly that is 60 to 75 feet long and a variety of hammers namely diesel, drop or hydraulic hammers for driving piles that may be sixty feet long.

Figures 3A, 3B, 3C:
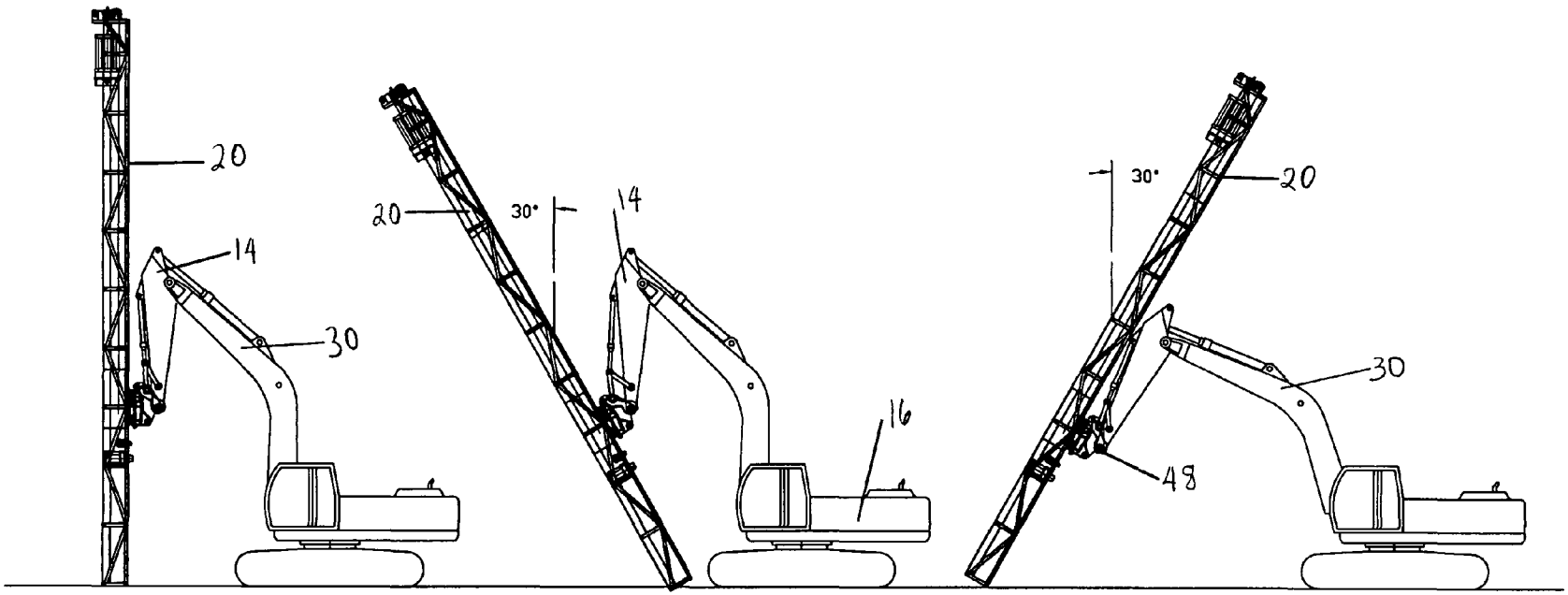
FIG. 3*a* in a side elevational view illustrates the system of mounting a pile driver of FIG. 1*a*.
FIG. 3*b* in a side elevational view illustrates the system of mounting a pile driver tilted forward by the boom of the excavator.
FIG. 3*c* in a side elevational view illustrates the system of mounting a pile driver tilted backward by the boom of the excavator.

Referring to FIGS. 3*a* to 3*c*, upon the attachment of the pivotable mounting assembly 40 and therefore the lead assembly 20 to the front stick 14 of the excavator, the lead assembly's position may be adjusted to a maximum of 30° forwards and backwards of the vertical plane. Specifically the boom 30 of the excavator 16 can be adjusted without moving the front stick 14 to allow for the desired adjustment. The pile driver 12 and specifically the hydraulics of the pile driver 12 may be powered by the excavator 16 or in the alternative, the pile driver 12 may be powered by a separate power pack.

Typically the foundation piles 18 that are being driven are pipe piles, timber piles or h-piles by way of example only. As such the diameter of the piles are typically six inches in diameter or larger, and have a length of forty feet long.

In operation, the bucket of the excavator is removed from the front stick 14 of the excavator 16. The front stick 14 is then positioned and engages the quick connecting means 46 and specifically the quick change adapter 48 thereby connecting the excavator 16 to the pile driver 12. The position of the lead assembly 20 may then be adjusted left or right, backwards or forwards to the desired position by the operator. The pile is then attached to the first lifting means 32 and positioned within the lead assembly 20. The aligning means 26 is engaged to accurately position the pile 18 within the set of leads 28. The hammer 22 may then be engaged by the second lifting means 34 and the pile 18 may be driven into the ground. Once the driving of the pile 18 has started, the set of leads 28 and the front stick 14 do not move. Various types of hammers may be used within the lead assembly 20, such as drop hammers, hydraulic hammers or vibratory hammers by way of example only.

In accordance with another embodiment of the present invention there is provided a system for mounting a drilling system to a front stick of an excavator including a lead assembly that has a drilling member slidably mounted to the lead assembly. The lead assembly further includes at least one lifting means. A pivotable mounting assembly is mounted to the lead assembly and adapted to adjust the position of the lead assembly. The system further includes a quick connecting means adapted to engage both the pivotable mounting assembly and the front stick of the excavator. The lead assembly may be further defined as a U-shaped, set of leads. The drilling member is slidable mounted to the U-shaped set of leads which allows the drilling member to seamlessly move up and down along the set of leads. The drilling member may be further defined as any type of drill or auger able to engage the ground surface.

Other variations and modifications of the invention are possible. All such modifications or variations are believed to be within the sphere and scope of the invention as defined by the claims appended hereto.

I claim:

1. A lead assembly system configured to removably and releasably mount to an excavator having a pivotable boom connected at one end to the excavator and a pivotable front stick connected at the other end of the boom, the lead assembly system comprising:

(a) a set of leads between about 48 and about 80 feet long having a driver that has a hammer slidably mounted to the set of leads;

(b) at least one lifting means for engaging the driver and moving the driver on the leads;

(c) a pivotable mounting assembly mounted to the set of leads and adapted to adjust the position of the set of leads about a vertical plane, the pivotable mounting assembly comprising a mounting head having a pivoting mechanism that allows for the pivot of the lead assembly up to a maximum 20° left or right on the vertical plane without movement of the boom or front stick of the excavator, and (d) a quick connect coupling having a pair of spaced-apart plates, each plate having a pair of recesses formed in an edge thereof, the quick connect coupling connected to the pivotable mounting assembly and configured to removably and releasably mount to the front stick of the excavator and to allow for the quick engagement and disengagement of the lead assembly system to and from the front stick, wherein a position of the lead assembly system is adjustable via the pivotable boom up to a maximum of 30° forwards and backwards of the vertical plane without movement of the front stick.

2. The lead assembly system according to claim 1, wherein the lifting means further comprises a first lifting means that lifts an object into the lead assembly and a second lifting means that lifts and lowers the driver.

3. The lead assembly system according to claim 2, wherein the first and second lifting means are hydraulic winches.

4. The lead assembly system according to claim 1, wherein a first recess of the pair of recesses of the quick connect coupling is positioned in a first direction, and wherein a second recess of the pair of recesses is positioned in a second direction, the first direction being perpendicular to the second direction.

5. A system configured to removably and releasably mount to a pivotable front stick of an excavator for driving piles, the front stick being connected to an end of a pivotable boom, the other end of the boom being connected to the excavator, the system comprising:

(a) a lead assembly having a hammer slidably mounted to a set of leads between about 48 and about 80 feet long, the hammer being configured to seamlessly move up and down along the set of leads, and at least one lifting means and an aligning means adapted to align the pile once positioned in the lead assembly;

(b) a pivotable mounting assembly mounted to the lead assembly and adapted to adjust the position of the lead assembly about a vertical plane, the pivotable mounting assembly comprising a mounting head having a pivoting mechanism that allows for the pivot of the lead assembly up to a maximum 20° left or right on the vertical plane without movement of the boom or front stick of the excavator; and (c) a quick connect coupling having a pair of spaced-apart plates, each plate having a pair of recesses formed in an edge thereof, the quick connect connected to the pivotable mounting assembly and configured to removably and releasably mount the front stick of the excavator to allow for the quick engagement and disengagement of the system to and from the front stick;

wherein the lifting means lifts the pile into the lead assembly and lowers the hammer, and wherein a position of the lead assembly is adjustable via the pivotable boom up to a maximum of 30° forwards and backwards of the vertical plane without movement of the front stick.

6. The system according to claim 5, wherein the lifting means further comprises a first lifting means that lifts the pile into the lead assembly and a second lifting means that lifts and lowers the hammer.

7. The system according to claim 6, the first and second lifting means may be defined as hydraulic winches.

8. The system according to claim 7, wherein the aligning means further comprises at least two paddles and an engaging mechanism.

9. The system according to claim 8, wherein the paddles and engaging mechanism are located at the bottom of the set of leads to engage to align the pile.

10. The system according to claim 9, wherein the pivotable mounting assembly is secured to the lead assembly at a point within an attachment zone.

11. The system according to claim 10, wherein the attachment zone is defined as an area on the set of leads that allows for the correct balance of the positioning of the set of leads relative the excavator.

12. The system according to claim 5, wherein the pile driver is powered by the excavator.

13. The system according to claim 5, wherein the pile driver is powered by a separate power pack.

14. The system according to claim 5, wherein a first recess of the pair of recesses of the quick connect coupling is positioned in a first direction, and wherein a second recess of the pair of recesses is positioned in a second direction, the first direction being perpendicular to the second direction.

15. A combination comprising:

(i) an excavator having a pivotable boom connected at one end to the excavator and a pivotable front stick connected at the other end of the boom; and (ii) a lead assembly system configured to removably and releasably mount to the excavator, the lead assembly comprising:

(a) a set of leads between about 48 and about 80 feet long having a driver that has a hammer slidably mounted to the set of leads;

(b) at least one lifting means for engaging the driver and moving the driver on the leads;

(c) a pivotable mounting assembly mounted to the set of leads and adapted to adjust the position of the set of leads about a vertical plane, the pivotable mounting assembly comprising a mounting head having a pivoting mechanism that allows for the pivot of the lead assembly up to a maximum 20° left or right on the vertical plane without movement of the boom or front stick of the excavator; and (d) a quick connect coupling having a pair of spaced-apart plates, each plate having a pair of recesses formed in an edge thereof, the quick connect coupling connected to the pivotable mounting assembly and configured to removably and releasably mount to the front stick of the excavator and to allow for the quick engagement and disengagement of the lead assembly system to and from the front stick, wherein a position of the lead assembly system is adjustable via the pivotable boom up to a maximum of 30° forwards and backwards of the vertical plane without movement of the front stick.

16. A method for removably and releasably coupling a lead assembly system to an excavator, wherein the (i) the excavator comprises a pivotable boom connected at one end to the excavator and a pivotable front stick connected at the other end of the boom, the lead assembly system; and (ii) the lead assembly system comprises:

(a) a set of leads between about 48 and about 80 feet long having a driver slidably mounted to the set of leads;

(b) at least one lifting means for engaging the driver and moving the driver on the leads;

(c) a pivotable mounting assembly mounted to the set of leads and adapted to adjust the position of the set of leads about a vertical plane; and (d) a quick connect coupling having a pair of spaced-apart plates, each plate having a pair of recesses formed in an edge thereof, the quick connect coupling connected to the pivotable mounting assembly and configured to removably and releasably mount to the front stick of the excavator and to allow for the quick engagement and disengagement of the lead assembly system to and from the front stick, the method comprising:

removing an excavator bucket attached to the front stick; and attaching the quick connect coupling of the lead assembly system to the front stick of the excavator, the driver of the lead assembly having a hammer that is configured to drive a pile into the ground without substantially moving the front stick, the boom, and the excavator with respect to the ground, wherein the pivotable mounting assembly comprises a mounting head having a pivoting mechanism that allows for the pivot of the lead assembly up to a maximum 20° left or right on the vertical plane without movement of the boom or front stick of the excavator and wherein a position of the lead assembly system is adjustable via the pivotable boom up to a maximum of 30° forwards and backwards of the vertical plane without movement of the front stick.

17. The method according to claim 16, further comprising:

detaching the quick connect coupling of the lead assembly system from the front stick of the excavator; and attaching an excavator bucket to the front stick after the lead assembly system has been detached from the excavator.

* * * * *